United States Patent [19]

Roberts

[11] 4,456,024

[45] Jun. 26, 1984

[54] FREEZE PROTECTION VALVE ASSEMBLY

[76] Inventor: John I. Roberts, P.O. Box 83, Dickinson, Tex. 77539

[21] Appl. No.: 458,192

[22] Filed: Jan. 17, 1983

[51] Int. Cl.[3] ..... E03B 7/12

[52] U.S. Cl. ..... 137/62; 237/80; 251/77

[58] Field of Search ..... 137/59, 61, 62, 79; 237/80; 251/77

[56] References Cited

U.S. PATENT DOCUMENTS

| | | | |
|---|---|---|---|
| 1,143,762 | 6/1915 | Hooks | 137/79 |
| 1,268,648 | 6/1918 | Van Meter | 137/62 |
| 1,338,469 | 4/1920 | Waage et al. | 137/62 |
| 1,554,344 | 9/1925 | Haapanen | 137/62 |
| 1,558,276 | 10/1925 | Peterson | 137/62 |
| 1,849,491 | 3/1932 | Kelley | 137/61 |
| 2,060,994 | 11/1936 | Kindervater | 137/79 |
| 3,369,556 | 2/1968 | Allderdice | 137/79 |
| 3,618,625 | 11/1971 | Walters | 137/62 |

*Primary Examiner*—George L. Walton

*Attorney, Agent, or Firm*—Russell H. Schlattman

[57] ABSTRACT

This invention is a freeze protection valve assembly for preventing the freezing of water in pipes of residential and the like water systems. The valve is positioned in a reservoir containing water of the water system. If the water temperature falls below a predetermined minimum, the valve opens discharging water from the system at the same time bringing into the system the warmer waters from the underground supply. Since the valve is activated by the temperature of the water itself, water waste is minimized.

1 Claim, 1 Drawing Figure

FREEZE PROTECTION VALVE ASSEMBLY

TECHNICAL FIELD

This invention relates to the combination of a freeze protection valve and housing therefor. More particularly, this invention relates to such a combination having utility in preventing the freezing of water in pipes of residential and the like water systems, thereby avoiding the rupture of such pipes where exposed to freezing conditions.

BACKGROUND ART

The need for preventing the freezing of water in residential water systems is well known. Upon freezing, water/ice expands, ultimately rupturing the pipes. The resulting damage can be quite extensive; the repair can be quite expensive.

In northern climates where extended periods of subfreezing temperatures are encountered rather drastic protection measures are necessary. Such measures include the burying of pipes, insulation of pipes, draining of exposed sections of pipes with the onset of the freezing weather season, etc.

In southern, more temperate climates, such measures are seldom employed. In such climates, freezing conditions are infrequent and of short duration. However, they do occur. A common practice to prevent freezing in the pipes when conditions conducive thereto are forecast is to partially open a valve in the system to permit a continuous water flow in the system. While effective, such a practice has drawbacks. It is exceedingly wasteful of water. It depends upon someone being present to be aware of the forecast and take remedial action.

To avoid such drawbacks, a number of devices have been developed to automatically initiate the flow of water with the onset of freezing conditions and stop the flow of water when the freezing conditions have passed. Such a device is shown in U.S. Pat. No. 3,369,556. That device is a valve actuated by a change in the temperature of the atmosphere outside the water pipe. In southern climates, while the atmospheric temperature may at times drop below freezing, the period of low temperature is frequently of insufficient duration to cause freezing of water in the pipes. Thus, this device would initiate the flow of water long before necessary or, at times, when unnecessary to prevent freezing in the pipes.

Several devices have been developed to be attached to the end of a water faucet, which devices are actuated by a drop in temperature to initiate a flow of water. U.S. Pat. Nos. 3,446,226 and 4,205,698 are examples of such devices. Operation of these devices depend on ambient temperatures rather than water temperature and prevent the normal use of the faucet when attached.

It is an object of this invention to provide an improved freeze protection valve assembly which initiates the flow of water in a water system as the temperature of the water approaches freezing and wherein waste of water is minimized and no interference with the normal use of the water system is encountered. Other objects will become apparent from the description of the invention.

BRIEF STATEMENT OF THE INVENTION

The novel freeze protection valve assembly of this invention comprises a reservoir having an inlet fitting to attach the reservoir to a segment of pipe of a water supply system and an outlet fitting to which can be attached a faucet permitting the reservoir to be maintained full of water from the water supply system when the faucet is closed. Disposed through the wall of the reservoir, preferably above the bottom of the reservoir, is a temperature actuated valve which will open and cause water to flow from the reservoir at a predetermined minimum temperature and close and remain closed at any temperature higher than said minimum temperature. The valve comprises a valve body having a seat, a valve member moveably disposed to engage said seat, an expandable chamber or bellows containing a liquid which expands in volume as the temperature increases and contracts as the temperature decreases resulting in the chamber or bellows extending as the temperature increases and retracting as the temperature decreases, a driving connection between said chamber and said valve member and lost motion means to maintain said valve member in said seat as the chamber extends or retracts with changing temperatures above said minimum and withdraws said valve member and maintains it away from said seat at said minimum temperature and below.

DESCRIPTION OF THE PREFERRED EMBODIMENT

Figure 1:
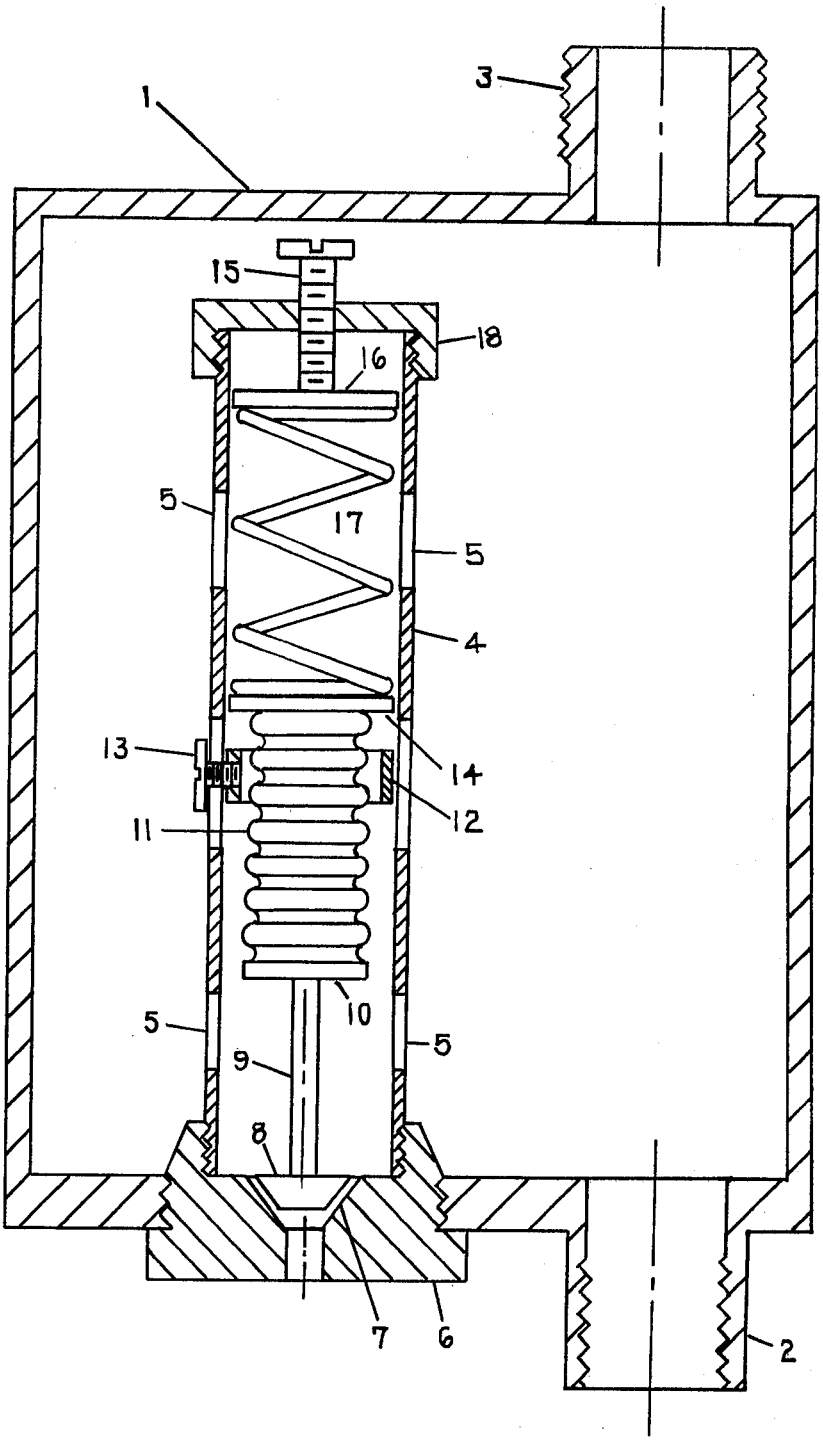
FIG. 1 is a schematic cross section of the novel freeze protection valve assembly of this invention.

Referring to FIG. 1, cylindrical reservoir 1 is provided, closed at top and bottom, with inlet fitting 2 to permit the reservoir to be attached to a segment of pipe of a water supply system and outlet fitting 3 to which can be attached a conventional faucet. The reservoir can be fabricated from metal or a suitable polymeric material, such as polyvinyl chloride. The position of the fittings can be varied but should be such that, when installed and the outlet closed, the reservoir will be maintained full of water from the water supply system.

Disposed through the wall of the reservoir is the valve assembly. It consists of tubular member 4 having a number of ports 5 to permit it to be filled with water from the reservoir. Tubular member 4 is attached to connecting fitting 6 containing valve seat 7. Valve member 8 is moveably disposed to engage or disengage seat 7 thereby permitting or preventing the flow of water therethrough. Valve member 8 is connected to rod 9 attached to plate or disc 10 which is rigidly attached to expansion chamber or bellows 11.

Cylindrical collar 12 is positioned inside tubular member 4 and retained in place by means of screw 13 passing through an appropriate elongated slot in tubular member 4. The elongated slot permits the positioning of cylindrical collar 12 at various distances from the valve end of the assembly.

Bellows 11 has a maximum diameter such that it will freely pass through cylindrical collar 12 during expansion or contraction.

The end of bellows 11 opposite the valve end of the assembly is attached to plate 14 having a diameter such that any travel of the plate toward the valve end of the assembly responsive to a contraction in bellows 11 will be stopped by cylindrical collar 12.

Tubular member 4 is capped with member 18 containing adjusting screw 15 attached to disc or plate 16. Coil springs 17 is disposed between plate 16 and plate 14. The compressive force of the coil spring 17 can be adjusted by means of adjusting screw 15.

In operation, in the case of rising temperatures, the bellows would expand against the compressive force of the spring providing the lost motion means to permit the bellows to expand without rupturing with temperatures above the desired minimum. The compressive force of the spring would maintain the valve in its seat. As temperatures decreased, the bellows would retract, continually maintaining the valve in its seat, until the movement of plate 14 was stopped by means of adjustable collar 12. Any further decrease in temperature would result in the retraction of the bellows pulling the valve from its seat and initiating a flow of water from the system.

Adjustable cylindrical collar 12 provides a rather precise means of adjusting the assembly to permit the valve to open at a predetermined temperature. Coil spring 17 provides the necessary pressure to maintain the valve in its closed position until the predetermined temperature for its opening is reached.

The expansion chamber or bellows is filled with a suitable liquid wherein the volume of the liquid is directly proportional to its temperature. In such a liquid, its volume increases as its temperature increases, and decreases as its temperature decreases. Such liquids include various petroleum oils, lower alkyl alcohols, etc.

To prevent freezing of water in a conventional residential water supply system, the above described valve would be constructed and adjusted to open when the water temperature dropped to or slightly below the freezing temperature, for example, around 30° F. The valve assembly would be installed at a location in the water supply system which, when the valve is opened, would permit circulation of water through the system bringing into the system the warmer waters from the underground supply pipes on which the system depends. A convenient place of installation would be outside the residence on the extension pipe extending from the inside water supply system through the wall of the house to the outside to provide water for outdoor purposes. The location of the valve assembly merely has to be such to provide, when open, circulation of water in that portion of the system susceptible to the freezing temperatures.

The freeze protection valve assembly of this invention has a number of distinct advantages. The mechanical functioning of the valve can be checked at any time by merely depressing the valve member with a suitable object pressed against it through the valve outlet. The entire assembly is susceptible to easy dismantling for total visual inspection and adjustments. By locating the valve above the lower most portion of the reservoir, collection of sediment contained in the water system which could plug the valve or hamper its operation over an extended period of time is eliminated. Since the operation of the valve is governed by the temperature of the water itself and not the temperature of the outside ambient atmosphere, waste of water is minimized. Ambient temperatures below freezing but of insufficient duration to reduce the water temperature to the freezing point, will not activate the valve resulting in an unnecessary discharge of water. The valve assembly of this invention permits the normal use of the water supply system while the valve is installed.

What is claimed is:

1. A freeze protection valve assembly comprising, in combination, (1) a reservoir having an inlet fitting to attach said reservoir to a segment of pipe of a water supply system and an outlet fitting to which can be attached a faucet permitting normal use of the water supply, said inlet and outlet fittings being positioned such that when attached to said water supply system the reservoir is maintained full of water when the outlet to the reservoir is closed, and (2) a valve disposed through the wall of the reservoir above the bottom of the reservoir, said valve comprising a unitary assembly of a valve body having a seat, a valve member movably disposed to engage said seat, an expandable chamber containing a liquid which expands in volume as the temperature increases and contracts as the temperature decreases resulting in the chamber extending as the temperature increases and retracting as the temperature decreases, a driving connection between said chamber and said valve member, lost motion means to maintain said valve member in said seat as the chamber extends or retracts with changing temperatures above a selected minimum temperature, and adjustable stop means limiting the operation of the lost motion means permitting adjustment of the minimum temperature above which the lost motion means maintains said valve member in said seat.

* * * * *